US008188958B2

(12) United States Patent
Weiss et al.

(10) Patent No.: US 8,188,958 B2
(45) Date of Patent: May 29, 2012

(54) METHOD, DEVICE AND SYSTEM OF RESPONSE TIME COMPENSATION

(75) Inventors: Alex Weiss, Kadima (IL); Ilan Ben-David, Rosh Ha'ayin (IL)

(73) Assignee: Samsung Electronics Co., Ltd. (KR)

( * ) Notice: Subject to any disclaimer, the term of this patent is extended or adjusted under 35 U.S.C. 154(b) by 960 days.

(21) Appl. No.: 11/663,349

(22) PCT Filed: Oct. 16, 2005

(86) PCT No.: PCT/IL2005/001092

§ 371 (c)(1), (2), (4) Date: Mar. 21, 2007

(87) PCT Pub. No.: WO2006/040774

PCT Pub. Date: Apr. 20, 2006

(65) Prior Publication Data

US 2008/0143657 A1 Jun. 19, 2008

Related U.S. Application Data

(60) Provisional application No. 60/617,055, filed on Oct. 12, 2004.

(51) Int. Cl.
*G09G 3/36* (2006.01)

(52) U.S. Cl. ..... 345/89; 345/87; 345/204; 345/690; 345/92

(58) Field of Classification Search ..... 345/87–111, 345/204–215, 690–699
See application file for complete search history.

(56) References Cited

U.S. PATENT DOCUMENTS 4,775,891 A * 10/1988 Aoki et al. ..... 348/572
5,594,463 A * 1/1997 Sakamoto ..... 345/76
5,739,816 A * 4/1998 Kobayashi et al. ..... 345/204
5,923,310 A * 7/1999 Kim ..... 345/90

(Continued)

FOREIGN PATENT DOCUMENTS

EP 0 602 623 6/1994

(Continued)

OTHER PUBLICATIONS

K. Nakanishi, S. Takahashi, H. Oura, T. Matsumura, S. Miyake, K. Kobayashi, K. Oda, S. Tahata, A. Yuuki, J. Someya and M. Yamakawa: "Fast Response 15-in. XGA TFT-LCD with Feed-forward Driving (FFD) Technology for Multimedia Applications", SID'01 Digest, pp. 488-491 (2001).*

(Continued)

*Primary Examiner* — Lun-Yi Lao
*Assistant Examiner* — Gene W Lee
(74) *Attorney, Agent, or Firm* — Innovation Counsel LLP

(57) ABSTRACT

Some demonstrative embodiments of the invention include a method device and/or system of displaying an image on a display having an array of sub-pixel elements. The method may include, for example, obtaining a first set of one or more values by sampling values of one or more sub-pixel value-holders associated with one or more of said sub-pixel elements, the first set of values corresponding to one or more sub-pixels of a first frame of said image; receiving a second set of values corresponding to one or more sub-pixels of a second frame of said image; and updating the values of one or more of the sub-pixel value-holders based on the first and second sets of values. Other embodiments are described and claimed.

20 Claims, 6 Drawing Sheets

U.S. PATENT DOCUMENTS

| | | | | |
|---|---|---|---|---|
| 6,163,360 | A * | 12/2000 | Tanaka et al. | 349/172 |
| 6,249,269 | B1 * | 6/2001 | Blalock et al. | 345/97 |
| 6,329,974 | B1 * | 12/2001 | Walker et al. | 345/98 |
| 6,380,931 | B1 * | 4/2002 | Gillespie et al. | 345/173 |
| 6,597,329 | B1 * | 7/2003 | Moss | 345/55 |
| 6,703,856 | B2 * | 3/2004 | Fujita | 324/760.02 |
| 6,750,876 | B1 | 6/2004 | Atsatt et al. | |
| 7,382,349 | B1 * | 6/2008 | Kuhns | 345/102 |
| 2002/0175907 | A1 * | 11/2002 | Sekiya et al. | 345/211 |
| 2002/0196221 | A1 | 12/2002 | Morita | |
| 2003/0006949 | A1 * | 1/2003 | Sekiya et al. | 345/87 |
| 2003/0080931 | A1 * | 5/2003 | Chen et al. | 345/88 |
| 2003/0156092 | A1 * | 8/2003 | Suzuki et al. | 345/98 |
| 2003/0189541 | A1 | 10/2003 | Hashimoto | |
| 2004/0001039 | A1 * | 1/2004 | Shino et al. | 345/100 |
| 2004/0130559 | A1 | 7/2004 | Lee et al. | |
| 2004/0174389 | A1 * | 9/2004 | Ben-David et al. | 345/694 |
| 2004/0222956 | A1 * | 11/2004 | Shih | 345/89 |
| 2004/0246224 | A1 * | 12/2004 | Tsai et al. | 345/100 |
| 2005/0068343 | A1 * | 3/2005 | Pan et al. | 345/690 |
| 2005/0099549 | A1 * | 5/2005 | Chen et al. | 349/41 |
| 2005/0104824 | A1 * | 5/2005 | Shen et al. | 345/87 |
| 2005/0225522 | A1 * | 10/2005 | Wu et al. | 345/87 |
| 2005/0225525 | A1 * | 10/2005 | Wu et al. | 345/89 |
| 2006/0221037 | A1 * | 10/2006 | Solf et al. | 345/98 |
| 2008/0279470 | A1 * | 11/2008 | Warmuth et al. | 382/255 |

FOREIGN PATENT DOCUMENTS

| | | |
|---|---|---|
| WO | WO 00/41161 | 7/2000 |
| WO | WO 02/101644 | 12/2002 |

OTHER PUBLICATIONS

International Search Report for International Application No. PCT/IL05/01092 mailed Nov. 30, 2006.

* cited by examiner

METHOD, DEVICE AND SYSTEM OF RESPONSE TIME COMPENSATION

CROSS-REFERENCE TO RELATED APPLICATIONS

This application is a National Phase Application of PCT International Application No. PCT/IL2005/001092, entitled "Method, Device and System of Response Time Compensation", International Filing Date Oct. 16, 2005, published on Apr. 20, 2006 as International Publication No. WO 2006/040774, which in turn claims priority from U.S. Provisional Patent Application No. 60/617,055, filed Oct. 12, 2004, both of which are incorporated herein by reference in their entirety.

FIELD OF THE INVENTION

The invention relates to color display systems generally and, more particularly, to flat screen display panels, for example, liquid crystal displays.

BACKGROUND OF THE INVENTION

A Liquid Crystal Display (LCD) device may include an array of Liquid Crystal (LC) elements, which may be driven, for example, by Thin Film Transistor (TFT) elements. Each full-color pixel of a displayed image may be reproduced by three sub-pixels, each sub-pixel corresponding to a different primary color, e.g., each full pixel may be reproduced by driving a respective set of LC elements in the LC array, wherein each LC element is associated with a color sub-pixel filter element. For example, three-color pixels may be reproduced by red (R), green (G) and blue (B) sub-pixel filter elements. Thus, each sub-pixel may have a corresponding LC element in the LC array. The light transmission through each LC element may be controlled by controlling the orientation of molecules in the LC element. The response time of the LC element may be related to the length of time required for changing the orientation of the LC molecules. This may introduce an inherent delay in the process of modulating the transmittance of the LC elements.

The LCD device may be implemented to display scene images, which may include, for example, a sequence of frames, in accordance with a video input signal. Unfortunately, due to the inherent delay in mobilizing the molecules in the LC elements, the displayed image may appear blurred to a user, e.g., if the response time of the LC elements is significant in relation to the frequency at which the frames are displayed. In other words, the response time of the LC elements may depend on the value of the activation voltage of both a previous frame and a current frame. A response time that is longer than a refresh cycle of a pixel or sub-pixel corresponding to the LC element may result in the blurring effect, particularly in images or image portions with abrupt changes, e.g., images of fast moving objects. It may also result in a color shift effect of displayed colors. FIG. 1(A) illustrates a pixel response to an input pulse signal.

In order to reduce such "blurriness" of displayed images, the LCD device may implement a Response Time Compensation (RTC) method, for example, a Feed Forward Driving (FFD) method, to compensate for the slow pixel response. The FFD method may include a FFD module able to control a LC element based on a comparison between sub-pixel values of the LC element in a previous frame and in a current frame. For example, a Look Up Table (LUT) may be used to provide the LC element with a control signal based on the previous sub-pixel value and the current sub-pixel value.

FIG. 1(B) illustrates a conventional driver circuit for pixel response compensation. In order to create an overdrive signal to the pixel, a previous frame is stored in a frame buffer 101. Voltage values of pixels from a current frame and a previous frame may then be fed into a computation circuit 102, which may include a central processing unit (CPU), a look-up table (LUT), or a combination of both. The computation circuit 102 may subsequently output a compensated voltage to be applied to a column driver 103 to drive the pixel. Such conventional compensation method requires the use of frame buffer 101 having a sufficient memory capacity in order to store sub-pixel voltage values for the entire previous frame. The required size of such memory may be relatively large, e.g., a memory of approximately 6 Megabytes (MB) may be required for storing the sub-pixel values of a three-primary, e.g., RGB, display device having a 1080 by 1920 pixel resolution. The required size of the memory may be reduced, e.g., down to about 600 Kilobytes (KB), using suitable compression techniques, which may result in loss of detail and/or quality at varying degrees, as is known in the art.

BRIEF DESCRIPTION OF THE DRAWINGS

The invention will be understood and appreciated more fully from the following detailed description of embodiments of the invention, taken in conjunction with the accompanying drawings of which.

Figure 1A:
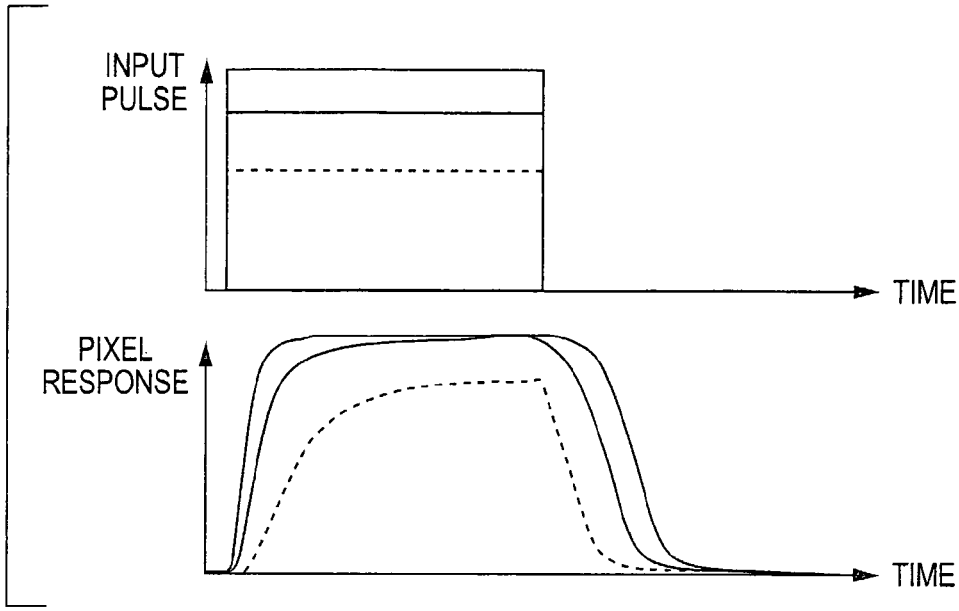
FIG. 1A (PRIOR ART)
FIG. 1(A) is a simplified graph illustration of a pixel response to an input pulse signal.
Figure 1B:
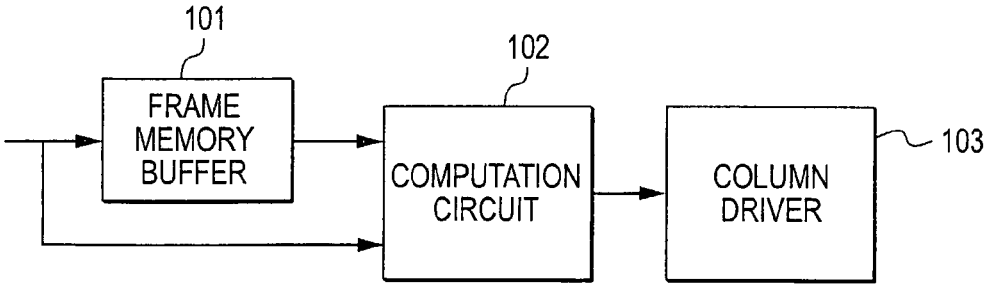
FIG. 1B (PRIOR ART)
FIG. 1(B) is a simplified block diagram of a conventional driver circuit for pixel response compensation.

It will be appreciated that for simplicity and clarity of illustration, elements shown in the figures have not necessarily been drawn accurately or to scale. For example, the dimensions of some of the elements may be exaggerated relative to other elements for clarity or several physical components included in one element. Further, where considered appropriate, reference numerals may be repeated among the figures to indicate corresponding or analogous elements. It will be appreciated that these figures present examples of embodiments of the present invention and are not intended to limit the scope of the invention.

DETAILED DESCRIPTION OF EMBODIMENTS OF THE INVENTION

In the following description, various aspects of the present invention will be described. For purposes of explanation, specific configurations and details are set forth in order to provide a thorough understanding of the present invention. However, it will be apparent to one skilled in the art that the present invention may be practiced without the specific details presented herein. Furthermore, some features of the invention relying on principles and implementations known in the art may be omitted or simplified to avoid obscuring the present invention.

Unless specifically stated otherwise, as apparent from the following discussions, it is appreciated that throughout the specification discussions utilizing terms such as "processing," "computing," "calculating," "determining," or the like, refer to the action and/or processes of an electronic circuit or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices. In addition, the term "plurality" may be used throughout the specification to describe two or more components, devices, elements, parameters and the like.

Embodiments of the present invention may be implemented by software, by hardware, or by any combination of software and/or hardware as may be suitable for specific applications or in accordance with specific design requirements. Embodiments of the present invention may include units and sub-units, which may be separate of each other or combined together, in whole or in part, and may be implemented using specific, multi-purpose or general processors, or devices as are known in the art. Some embodiments of the present invention may include buffers, registers, storage units and/or memory units, for temporary or long-term storage of data and/or in order to facilitate the operation of a specific embodiment.

Figure 2:
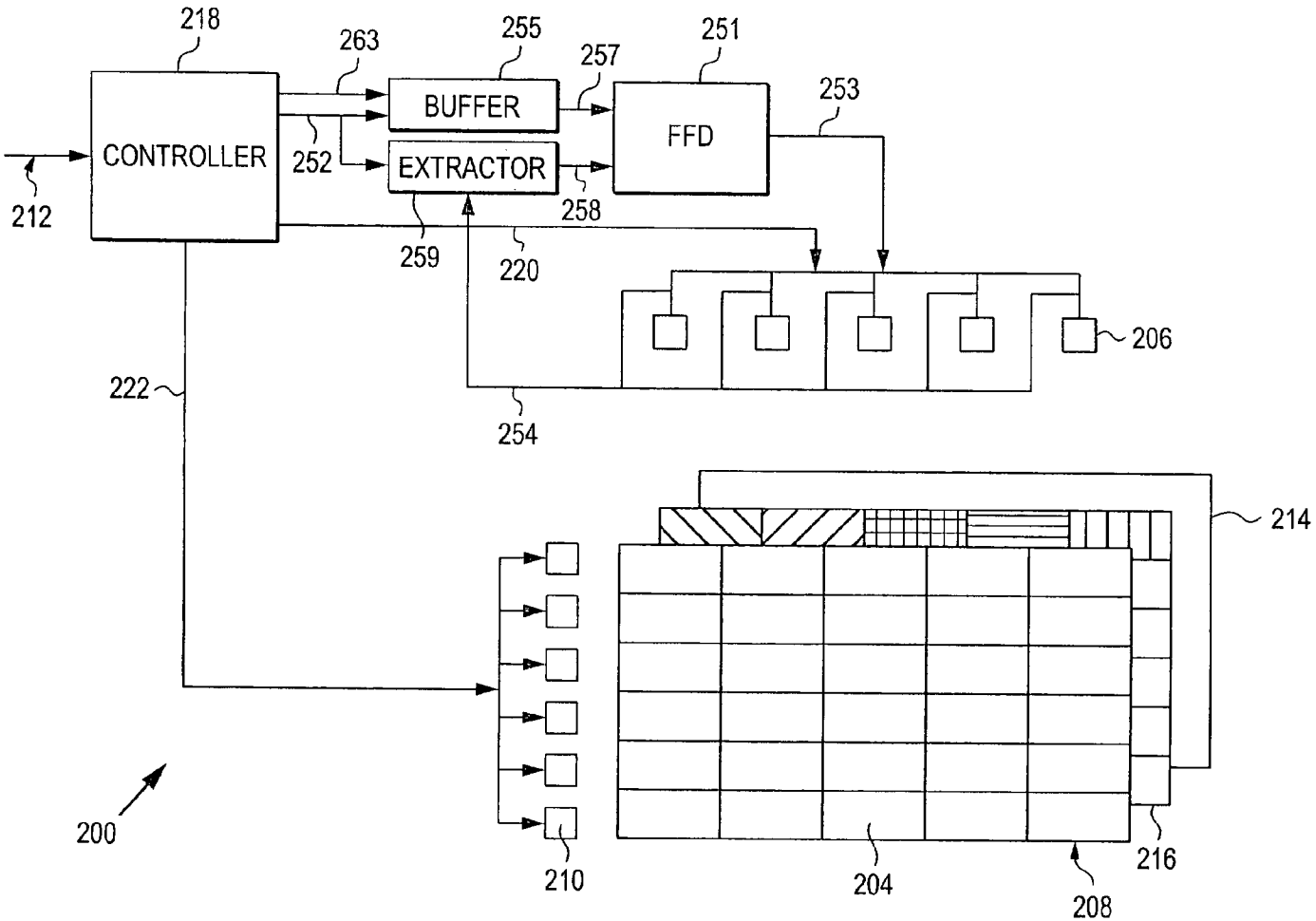
FIG. 2 is a schematic illustration of a Liquid Crystal Display (LCD) system in accordance with some demonstrative embodiments of the invention.

Reference is now made to FIG. 2, which schematically illustrates a Liquid Crystal Display (LCD) system 200 in accordance with some demonstrative embodiments of the invention.

According to some demonstrative embodiments of the invention, system 200 may include a Liquid Crystal (LC) array 208 including LC elements ("cells") 204, for example, an LC array using Thin Film Transistor (TFT) active-matrix technology, as is known in the art. At least some of cells 204 may be connected, for example, to a horizontal ("row") line and a vertical ("column") line, e.g., as described in detail below with reference to FIG. 3.

System 200 may also include a first set of electronic circuits 210 ("row drivers"), e.g., operationally associated or connected with the row lines; and a second set of electronic circuits 206 ("column drivers"), e.g., operationally associated or connected with the column lines. Drivers 210 and 206 may be implemented for driving cells 204 of LC array 208, e.g., by active-matrix addressing, as is known in the art. System 200 may also include a filter array 216 juxtaposed with LC array 208, e.g., as described below.

According to some demonstrative embodiments of the invention, each full-color pixel of a displayed image, or image frame, may be reproduced by three or more sub-pixels, each sub-pixel corresponding to a different primary color, e.g., each full-color pixel may be reproduced by driving a corresponding set of three or more sub-pixels. For each of the three or more sub-pixels there may be a corresponding cell in LC array 208, and each LC cell may be associated with a color filter element of filter array 216, corresponding to one of the three or more primary colors. The transmittance of each of the sub-pixels may be controlled, for example, by applying to a cell or cells of LC array 208 control signals 253 and/or 222, e.g., via column drivers 206 and row drivers 210 respectively.

A back-illumination source 214, e.g., a polychromatic or white light source, as is known in the art, may provide the illumination needed to produce color images. The intensity of white light provided by back-illumination source 214 may be spatially modulated by LC elements 204 of LC array 208, thereby selectively controlling the illumination of each sub-pixel according to image data for that sub-pixel. The selectively attenuated light of each sub-pixel passes through the corresponding color filter element of filter array 216, thereby producing desired color sub-pixel combinations. The human vision system of a user spatially integrates the light filtered through the different color sub-pixels to perceive a color image.

According to some demonstrative embodiments of the invention, system 200 may include a controller 218 able to receive an input signal, e.g., a video input signal 212. Video input signal 212 may carry data corresponding to a sequence of video frames, e.g., in the form of consecutive rows, wherein the data of each row corresponds to a momentary row of an image to be reproduced by system 200. For example, signal 212 may include a High Definition Television (HDTV) video input signal or any other video signal as known in the art.

According to some demonstrative embodiments of the invention, controller 218 may produce a signal 252 carrying primary color sub-pixel data including one or more sub-pixel values ("current values") corresponding to a row to be reproduced ("current row"), e.g., as described below. Controller 218 may also provide control signals 220 to column drivers 206 and/or control signals 222 to row drivers 210. Values of either or both of signals 220 and 222 may be based on input signal 212, e.g., as is known in the art.

According to demonstrative embodiments of the invention, system 200 may also include a Response Time Compensation (RTC) module. For example, system 200 may include a Feed Forward Driving (FFD) module 251, an extractor 259, and a buffer 255. Extractor 259 may extract and/or sample, a signal 254 including one or more extracted sub-pixel values ("previous values") from LC array 208, e.g., via column drivers 206, as described below. Each extracted previous value may correspond to the value of a respective sub-pixel of signal 254 in a previously reproduced row ("the previous row"), as described below. Controller 218 may provide buffer 255 with a timing signal 263, such that FFD module 251 may receive the current values of a row of sub-pixels, e.g., from buffer 255 via signal 257, substantially concurrently with the extracted previous values of the same row of sub-pixels, e.g., received from extractor 259 via signal 258. FFD module 251 may then provide column drivers 206 with an overdrive sub-pixel data signal 253, e.g., based on a comparison between the sub-pixel values of signals 257 and 258. For example, FFD module 251 may produce sub-pixel signal 253 based on a difference between the sub-pixel current value of signal 257 and the determined sub-pixel previous value of signal 258. FFD module 251 may include, for example, a Look-Up Table (LUT) having stored therein output signal values corresponding to a difference between a current value of a sub-pixel and a previous value of the sub-pixel, e.g., as is known in the art.

Aspects of the invention are described herein in the context of a demonstrative embodiment of a controller, e.g., controller 218, an extractor, e.g., extractor 259, a FFD module, e.g., FFD module 251, and/or a buffer, e.g., buffer 255, being separate units of a display system, e.g., system 200. However, it will be appreciated by those skilled in the art that, according to other embodiments of the invention, any other combination of integral or separate units may also be used to provide the desired functionality, for example, the controller may also include the extractor, the FFD module, and/or the buffer. Furthermore, although the above description relates to system 200 including a FFD module, according to other embodiments of the invention system 200 may be modified to include any suitable RTC module.

According to some embodiments of the invention, system 200 may include an n-primary Liquid Crystal Display (LCD) system, wherein n is greater than three. Certain aspects of monitors and display devices with more than three primaries, in accordance with demonstrative embodiments of the invention, are described in International Application PCT/IL02/00452, filed Jun. 11, 2002, entitled "DEVICE, SYSTEM AND METHOD FOR COLOR DISPLAY" and published 19 Dec. 2002 as PCT Publication WO 02/101644 ("Reference 1"), the disclosure of which is incorporated herein by reference in its entirety. According to these demonstrative embodiments, controller 218 may be able to, inter alia, convert three primary data, e.g., of signal 212, into corresponding n-primary data, e.g., as described in Reference 1. Additionally, controller 218 may be able to process the n-primary data, for example, according to one or more attributes, e.g., a sub-pixel arrangement of filter array 216, e.g., as described in Reference 1. Accordingly, signals 252, 254, 258 and/or 257 may include n-primary sub-pixel data.

According to other demonstrative embodiments of the invention, system 200 may include a less-than-four-primary LCD system, e.g., a three-primary LCD system, a two color display, or a monochromatic display. Accordingly, in these embodiments, controller 218 may include, for example, a Timing Controller (TCON) as is known in the art, and signals 252, 254, 258 and/or 257 may include less-than-four-primary sub-pixel data.

It is known in the art that values of sub-pixels of displayed rows, which collectively form a frame, may be physically stored in their respective rows of storage capacitors or value-holders associated with the rows of sub-pixels of a LCD system. According to some demonstrative embodiments of the invention, system 200 may be adapted to utilize the sub-pixel values stored in the value-holders for determining the previous sub-pixel values, e.g., as described below.

Figure 3:
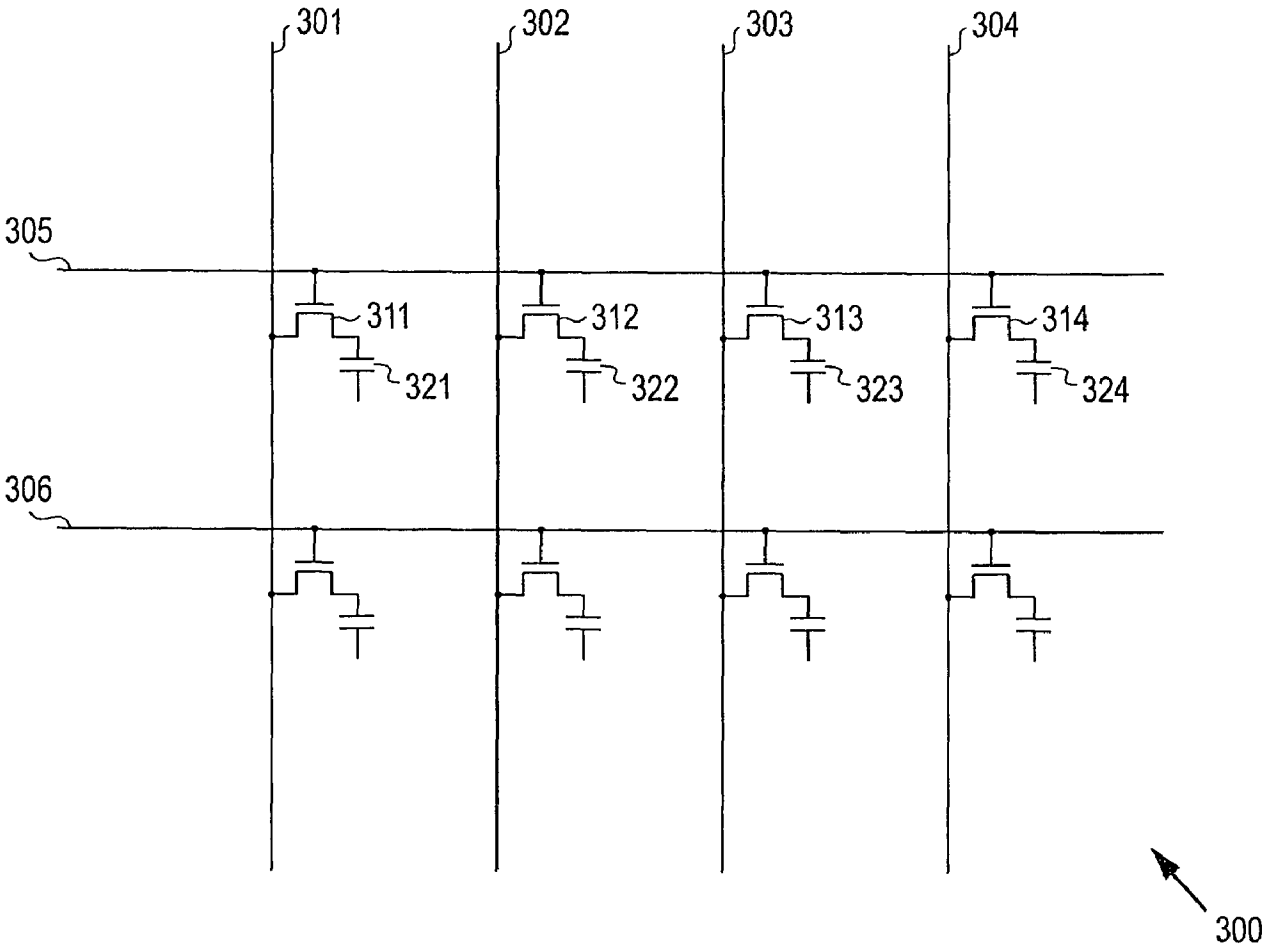
FIG. 3 is a schematic illustration of a segment of a Thin Film Transistor (TFT) arrangement, according to some demonstrative embodiments of the invention.

Reference is now made to FIG. 3, which schematically illustrates a segment 300 of LC array 208 (FIG. 2). According to some demonstrative embodiments of the invention, segment 300 may include a plurality of columns, e.g., columns 301, 302, 303, and 304, which may be connected to column drivers 206 (FIG. 2); and a plurality of rows, e.g., rows 305 and 306, which may be connected to row drivers 210 (FIG. 2).

According to some demonstrative embodiments of the invention, segment 300 may also include a plurality of switching elements, e.g., elements 311, 312, 313 and 314; and/or value-holders, e.g., storage capacitors 321, 322, 323 and 324, associated with a plurality of respective cross-points between one or more columns, e.g., columns 301, 302, 303, and 304, and one or more rows, e.g., row 305. One or more of the value-holders, e.g., storage capacitor 321, may physically store a voltage value that may be used to control the properties, such as luminance/color, of an associated sub-pixel. One or more of the switch elements, e.g., element 311, may be controlled by column driver 206 via a respective column line, e.g., line 301, and/or by row drivers 210 via a respective row line, e.g., line 305. One or more of the switch elements, e.g., element 311, may subsequently control the physical connection between a storage capacitor, e.g., capacitor 321, and a corresponding sub-pixel of LC array 208. When the display of a sub-pixel, a row of sub-pixels, or a frame of sub-pixels, is updated, the voltage of a corresponding pixel or corresponding pixels stored in one or more of the capacitors may be likewise updated. In other words, voltages stored in the storage capacitors may represent the displayed information of LCD system 200.

Figure 4:
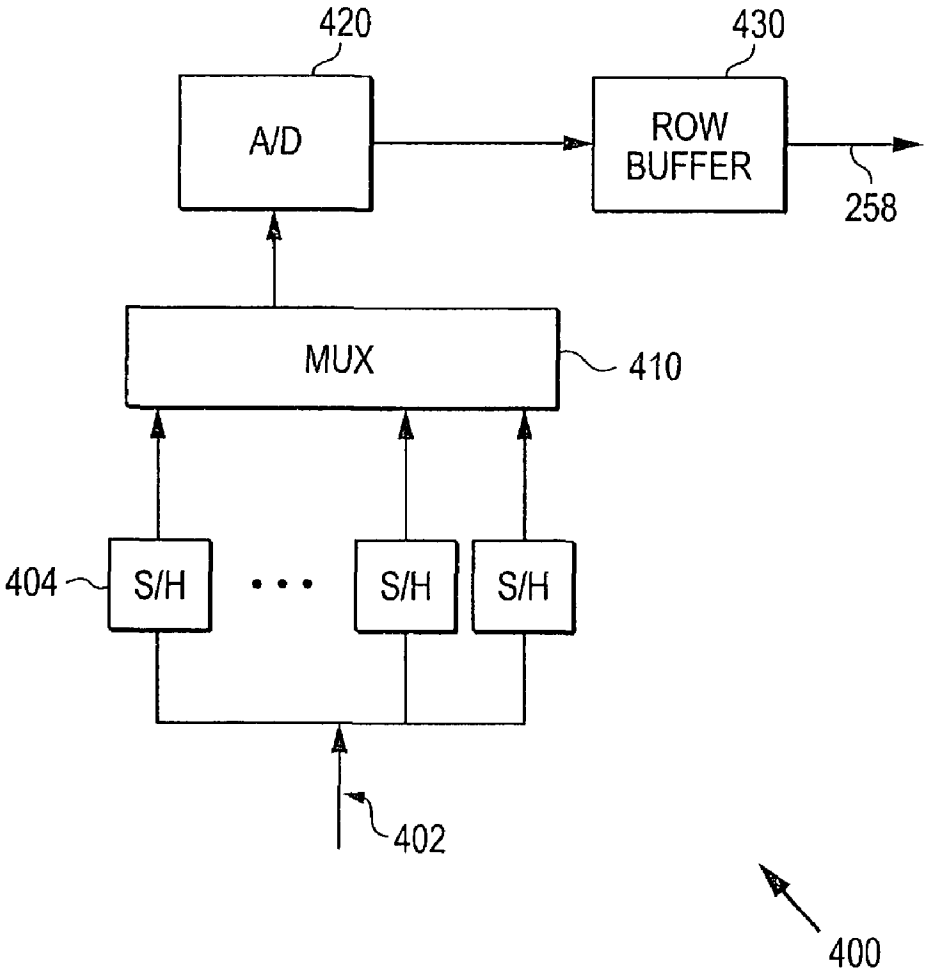
FIG. 4 is a schematic illustration of a sub-pixel value extractor in accordance with some demonstrative embodiments of the invention.

Reference is now made to FIG. 4, which schematically illustrates a block diagram of an extractor 400 in accordance with some demonstrative embodiments of the invention. According to some demonstrative embodiments of the invention, extractor 400 may be a demonstrative example of extractor 259 (FIG. 2).

Extractor 400 may include a plurality of sample-and-hold ("S/H") modules 404, which may be controlled, for example, by controller 218 (FIG. 2). S/H modules 404 may sample received analog voltage signal 402, e.g., including signal 254 (FIG. 2), and store values corresponding to the samples. Signal 402 may carry values of different sub-pixels to respective S/H modules 404. S/H modules 404 may generate signals corresponding to the sampled voltage values. The signals from modules 404, which may be in different time slots, may be multiplexed by a multiplexer 410 and provided to an analog-to-digital (A/D) converter 420. A/D converter 420 may be able to process the sampled signals received from multiplexer 410, e.g., in sequence, and to convert the analog signals into corresponding digital signals that may be received by a row buffer 430. Row buffer 430 may store the digital signals received form converter 420. The digital signals stored by buffer 430 may later be retrieved and provided as input to FFD module 251 (FIG. 2) as the determined previous sub-pixel values, e.g., of signal 258, as described below.

Figure 5:
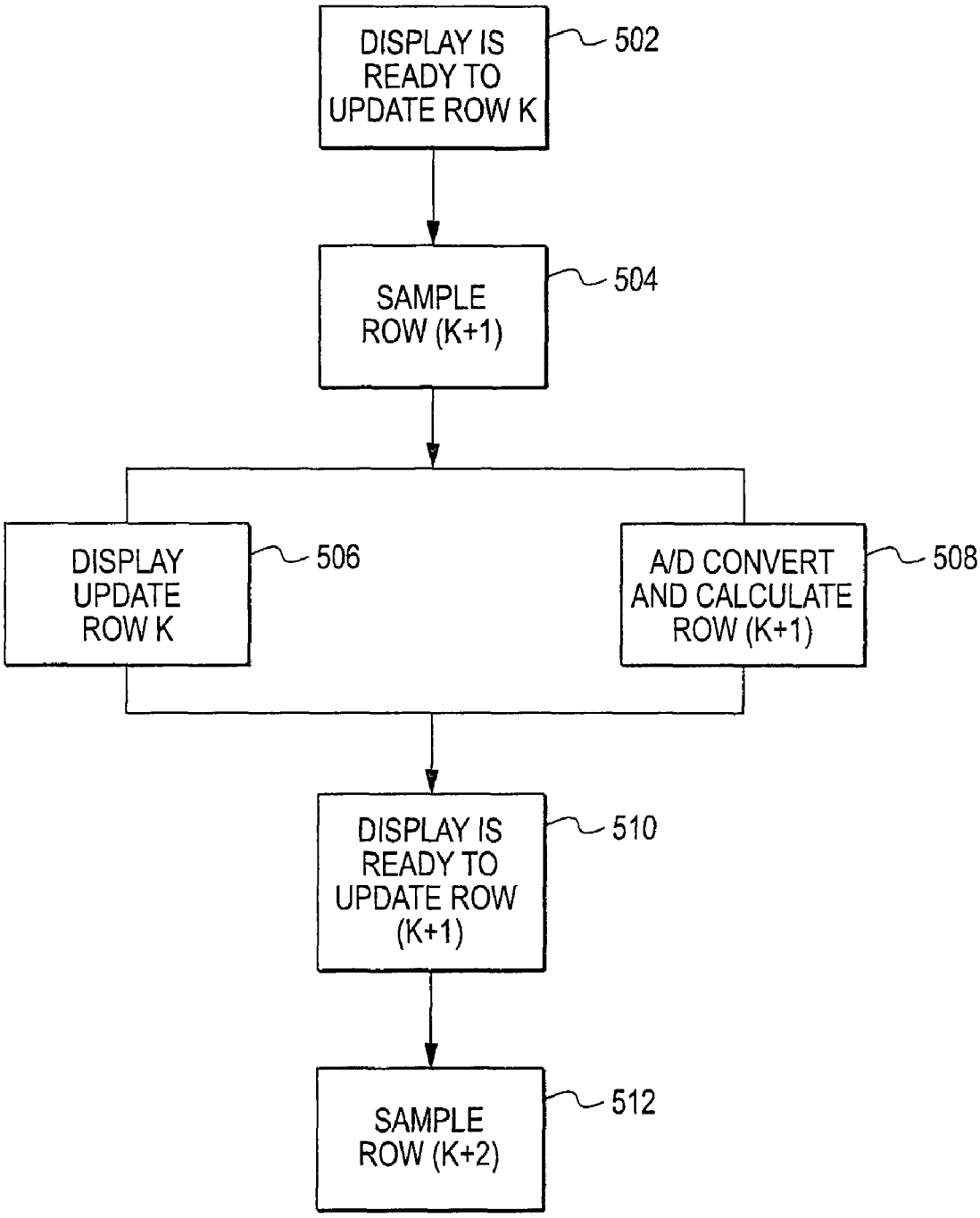
FIG. 5 is a schematic illustration of a method of updating sub-pixel values in accordance with some demonstrative embodiments of the invention.

Reference is now made to FIG. 5, which schematically illustrates a method of updating sub-pixel values, in accordance with some demonstrative embodiments of the invention. One or more operations of the method of FIG. 5 may be implemented, for example, by controller 218 (FIG. 2).

For simplicity of explanation and without loss of generality, it is assumed in the following demonstrative description that controller 218 may update information sequentially row-by-row. It is also assumed that the displayed values of a given row, e.g., a (k−1)-th row of sub-pixels have been displayed, and that the values of a succeeding row, e.g., a k-th row, of sub-pixels have already been produced by FFD module 251 and are ready to be applied to column drivers 206 for display. In other words, controller 218 may be ready to update values of sub-pixels of k-th row (block 502).

Before updating sub-pixels of row k, controller 218 may prepare values of sub-pixels for row (k+1). The driver of row (k+1), which follows row k, may be initially activated for a short period of time. The voltage values stored in the storage capacitors of row (k+1) may then be provided as input to extractor 259, in the form of signal 254, which may be sampled and then temporarily stored in respective S/H modules 404 (block 504). The voltage values of the capacitors may be sent to S/H modules 404, for example, in a sequential order.

According to some demonstrative embodiments of the invention, row driver 210 may be switched back to address row k, e.g., Once the voltage values of all the storage capacitors in row (k+1) have been sampled and saved in respective S/H modules 404. The sub-pixel values of row k, prepared by FFD module 251, may be applied to column driver 206, and row k of LC array 208 may be updated (block 506).

Extractor 259 may start preparing previous values of sub-pixels of row (k+1) to be provided as input to FFD module 251, e.g., while FFD module 251 is updating current values of sub-pixels to row k of LC array 208. The voltage values sampled and/or stored in modules 404 may be passed through multiplexer 410, and converted by A/D converter 420 into digital form from their in analog format. The digital signal may be provided as input to row buffer 430, e.g., sequentially (block 508).

FFD module 251 may process previous values of row (k+1), e.g., provided by extractor 259 via signal 258, and an input signal from buffer 255, e.g., signal 257, to produce Current Values of row (k+1), for example, once row k is updated by controller 218, and voltage values of row (k+1) are converted into digital format and saved in row buffer 430. Row (k+1) of LC array 208 may now be ready to be updated (block 510), and controller 218 may proceed to prepare values for the further following row, e.g., row (k+2) (block 512).

Figure 6:
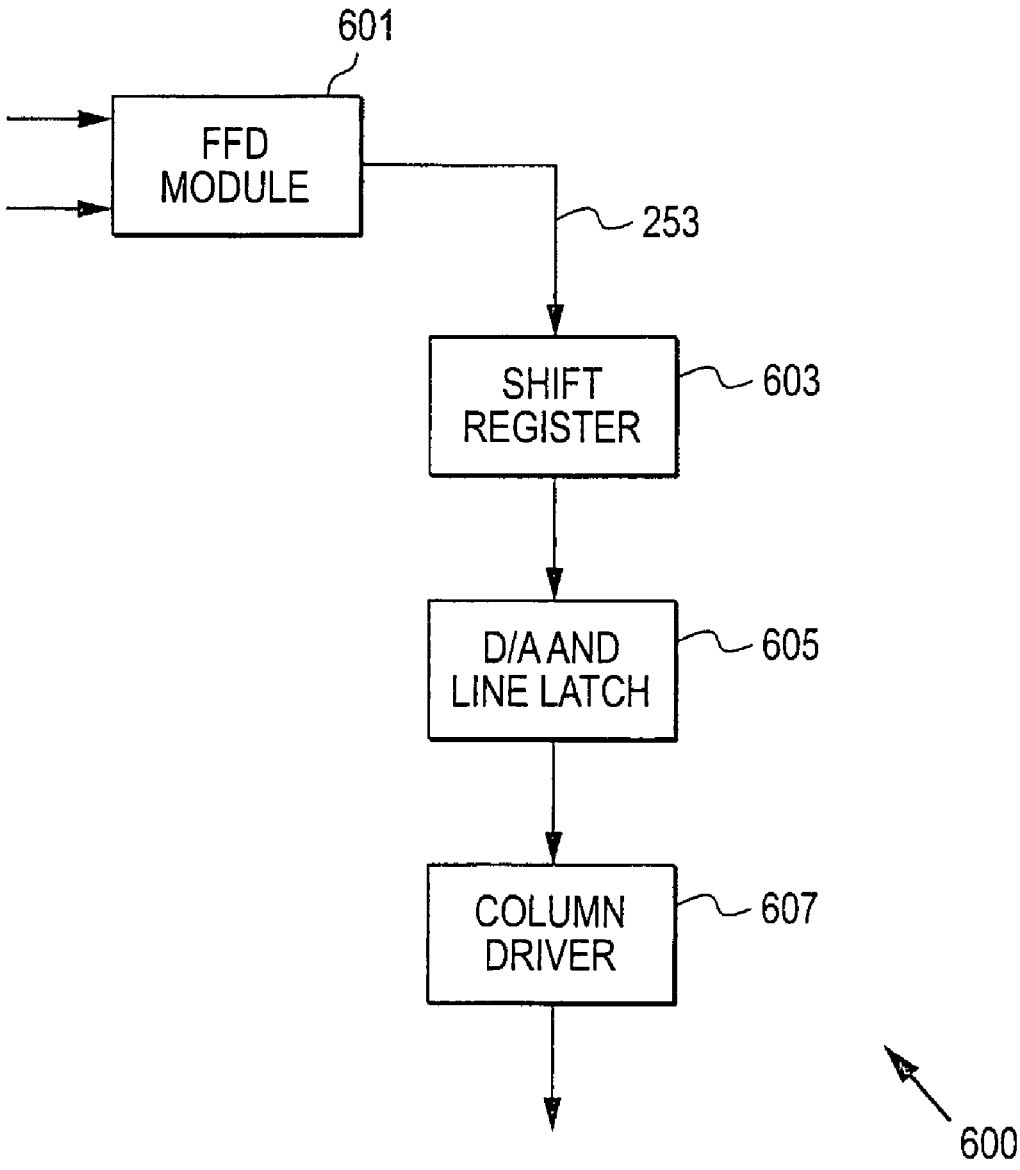
FIG. 6 is a simplified block diagram illustration of an arrangement for applying a sub-pixel signal to a driver, in accordance with some demonstrative embodiments of the invention.

Reference is now made to FIG. 6, which illustrates an arrangement 600 to apply to a column driver 607 voltages corresponding to current values of a row of sub-pixels, according to some demonstrative embodiments of the invention. Arrangement 600 may be implemented, for example, to update values of corresponding sub-pixels of LC array 208 (FIG. 2). In accordance with some demonstrative embodiments of the invention, arrangement 600 may include a FFD module 601, e.g., corresponding to FFD module 251 (FIG. 2), and/or column driver 607, e.g., corresponding to column driver 206 (FIG. 2).

According to some demonstrative embodiments of the invention, arrangement 600 may also include a shift register 603 and a line latch device 605. Line latch 605 may include, for example, a digital-to-analog (D/A) converter, e.g., as is known in the art. Units 603 and 605 may be implemented as separate units, or may be integrated as part of FFD module 601, as part of column driver 607, and/or in any other desired configuration, in accordance with specific implementations and/or design requirements.

According to some demonstrative embodiments of the invention, FFD module 601 may provide data signal 253 (FIG. 2) of current values of row driver (k+1) to shift register 603, e.g., in the process of updating displayed values of sub-pixels of row (k+1). Shift register 603 may temporarily store the values received from FFD module 601. Shift register 603 may provide the Current Values of row (k+1) to line latch device 605, e.g., after column driver 607 completes updating the sub-pixels of row k. Line latch device 605 may convert received digital signals into an analog format using its D/A converter, and then latch its output at received signal levels, for example, until a time for updating next row of sub-pixels. Column driver 607 may then apply the latched output of device 605 to update row (k+1) of LC array 208 (FIG. 2).

Although some embodiments of the invention are described herein assuming a row-by-row update of sub-pixel values of a LC array 208 (FIG. 2), it will be appreciated by those skilled in the art that other embodiments of the invention may include different updating schemes, such as updating two or more rows at a time, e.g., by extracting previous values of the voltages stored in the storage capacitors associated with the appropriate rows of the LC array 208 (FIG. 2).

It will be appreciated by those skilled in the art, that a LCD system according to demonstrative embodiments of the invention, e.g., LCD system 200 (FIG. 2), may include a row buffer, e.g., buffer 255 (FIG. 2), having a relatively small size, e.g., compared to conventional LCD system employing a frame buffer memory for storing previous frame pixels. For example, an LCD display according to embodiments of the present invention including 1080 lines, each including 1920 pixels, may include a row buffer memory having a size of less than 6 Kilobytes for storing the values of a row of pixels. This memory size is significantly smaller than the memory size generally used by conventional LCD systems, e.g., between 600 Kilobytes and 6 Megabytes.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A method of displaying an image on a liquid crystal display having an array of sub-pixel elements, the method comprising:

applying control signals to data lines connected to the sub-pixel elements from column drivers;

obtaining a first set of one or more values from the column drivers by sampling values of one or more sub-pixel value-holders associated with one or more of said sub-pixel elements, the first set of values corresponding to one or more sub-pixels of a first frame of said image;

receiving a second set of values corresponding to one or more sub-pixels of a second frame of said image; and updating the values of one or more of the sub-pixel value-holders based on the first and second sets of values, wherein the sub-pixel value holders are storage capacitors within the sub-pixel elements.

2. The method of claim 1, wherein the sub-pixel elements comprise liquid crystal elements.

3. The method of claim 1, further comprising activating the sub-pixel elements based on the values held by the sub-pixel value-holders to display the second frame of said image.

4. The method of claim 1, wherein sampling the sub-pixel value-holders comprises extracting voltage values.

5. The method of claim 4, further comprising multiplexing the extracted voltage values at different time slots.

6. The method of claim 1, wherein the one or more sub-pixel elements comprise a row of sub-pixels.

7. The method of claim 1, comprising adjusting the timing of the sampled first set of values to be substantially concurrent with the received second set of values.

8. The method of claim 7, wherein adjusting the timing comprises storing the second set of values in a buffer.

9. The method of claim 1, wherein each storage capacitor is connected to a data line.

10. The method of claim 1, wherein the values of one or more of the sub-pixel value-holders are updated by using a look-up table storing output signal values corresponding to a difference between the first and second sets of values.

11. A liquid crystal display device to generate an image to be displayed using an array of sub-pixel elements, the device comprising:

column drivers to apply control signals to data lines connected to the sub-pixel elements;

an extractor to obtain a first set of one or more values from the column drivers by sampling values of one or more sub-pixel value-holders operatively associated with one or more of said sub-pixel elements, the first set of values corresponding to one or more sub-pixels of a first frame of said image;

a controller to provide a second set of values corresponding to one or more sub-pixels of a second frame of said image; and a feed forward driving module to update the values of the sub-pixel value-holders based on the first and second set of values, wherein the sub-pixel value holders are storage capacitors within the sub-pixel elements.

12. The device of claim 11, wherein the sub-pixel elements comprise liquid crystal elements.

13. The device of claim 11, wherein the controller is to activate the sub-pixel elements to display the second frame of the image based on the values held by the sub-pixel value-holders.

14. The device of claim 11, wherein at least one of the sub-pixel value-holders comprises a capacitor controlled by a gate.

15. The device of claim 11, wherein the extractor comprises:

one or more sample-and-hold modules to sample one or more corresponding sub-pixel value-holders, and to adjust the sampled first set of values to different time slots; and a multiplexer to combine the sampled first set of values.

16. The device of claim 11, wherein the one or more sub-pixel elements comprise a row of sub-pixels.

17. The device of claim 11, wherein the controller is to adjust the timing of the sampled first set of values and the received second set of values to be substantially concurrent at the feed-forward driving module.

18. The device of claim 11, further comprising a buffer to store the second set of values received from the controller.

19. The liquid crystal display device of claim 11, wherein each storage capacitor is connected to a data line.

20. The liquid crystal display device of claim 11, wherein the values of one or more of the sub-pixel value-holders are updated by using a look-up table storing output signal values corresponding to a difference between the first and second sets of values.

* * * * *